United States Patent [19]

George

[11] 4,307,974

[45] Dec. 29, 1981

[54] EXPANSION JOINT SEAL

[76] Inventor: Joseph D. George, 1263 Royal York Rd., Islington, Ontario M9A 4C4, Canada

[21] Appl. No.: 127,929

[22] Filed: Mar. 6, 1980

[51] Int. Cl.[3] ..... E01C 11/04

[52] U.S. Cl. ..... 404/68; 52/396; 49/475; 14/16.5

[58] Field of Search ..... 404/68, 69, 64, 65; 52/396, 403; 14/16.5; 49/475

[56] References Cited

U.S. PATENT DOCUMENTS

| | | | |
|---|---|---|---|
| 2,013,195 | 9/1935 | Ward | 14/16.5 |
| 2,220,628 | 11/1940 | Stedman | 404/47 |
| 3,324,774 | 6/1967 | Boschi | 404/47 |
| 3,375,763 | 4/1968 | Welch | 14/16.5 X |
| 3,555,982 | 1/1971 | George | 14/16.5 X |
| 3,790,294 | 2/1974 | Trieste | 404/68 |
| 3,829,229 | 8/1974 | Britton | 404/69 |
| 4,063,840 | 12/1977 | Fordyce | 14/16.5 X |

OTHER PUBLICATIONS

"A Discussion of The Principles of Zero Maintenance Solutions As Applied To The Kinetics of Our Modern Bridges & Structures", by Stewart C. Watson, Copyright 1975; pp. 14 & 21.

*Primary Examiner*—Nile C. Byers, Jr.

*Attorney, Agent, or Firm*—Fetherstonhaugh & Co.

[57] ABSTRACT

The invention is an expansion joint seal for the gap in a bridge decking wherein load supporting splines are embedded in an elastomer strip that bridges the gap. The splines are at an incline to the longitudinal axis of the strip so that they have a rotational movement as the width of the gap changes.

3 Claims, 2 Drawing Figures

EXPANSION JOINT SEAL

This invention relates to an expansion joint seal for the gap between adjacent deck sections of a bridge.

In a typical concrete bridge structure the deck sections which form the bridge roadway are supported on columns. There is a gap between adjacent sections and the size of the gap is designed to accommodate the expansion and contraction of the bridge sections towards and away from each other with variations of temperature. The bridge deck sections expand in warm weather to reduce the size of the gap between adjacent sections. They contract in cold weather to increase the size of the gap between adjacent deck sections.

It is desirable to seal this gap because there is a tendency for drainage to fall through the gap and onto the bridge substructure. It deteriorates the bridge bearings and beams. Good bridge maintenance therefore requires that a seal be provided.

A well designed expansion joint seal for the gap between adjacent bridge deck sections will allow for relative movement of the deck sections at the gap; bridge the gap and support load passing over the deck sections as it travels across the gap; and prevent water, salt and other foreign substances from passing through the gap and onto the bridge columns.

Seals are available that will, with varying degrees of efficiency, fulfill these requirements.

One popular type of seal comprises a strip of elastomer material having a width to bridge marginal edges of adjacent bridge sections with three longitudinally extending strips of steel embedded therein. The centre strip of steel is mounted above the two other strips, one of which is located adjacent each marginal edge. The inside marginal portion of each of the edge mounted strips underlies the marginal edge portion of the centre strip. This arrangement permits relative movement of the deck sections with expansion and contraction thereof as the elastomer in the vertical extent between the centre section and the marginal sections yield. It does, however, involve heavy loading of the strip with the result that there is substantial stress at the union of the marginal edges of the strip and the deck sections. Stress at these unions requires strong anchorage which tends to break the concrete of the deck sections. The section therefore is subject to relatively high maintenance. A further disadvantage of the joint is that it must be made in lengths, at a factory, that are less than the transverse extent of bridge structures. The result is that the seal across the transverse extent of a bridge involves several cross joints. These seals tend to leak at these joints.

A further type of expansion joint is one described in this inventor's U.S. Pat. No. 3,555,982. This seal depends for expansion and contraction upon sliding motion between the elastomer strip and the load supporting splines and manufacturing precautions to prevent the splines from breaking through the elastomer under unlevel conditions of deck expansion must be taken.

It is an object of this invention to provide an expansion joint seal for the gap in a bridge decking that can be made at the factory of a length to extend across a bridge without a cross joint; that is capable of yielding as the deck sections expand and contract without unduly stressing the edges of the deck sections to which it is attached; wherein the load supporting reinforcing members tend to rotate in the general plane of the bridge deck as expansion and contraction takes place; that is convenient to manufacture; and that is serviceable in use.

With these and other objects in view an expansion joint seal for a gap in a bridge or like decking according to this invention comprises a strip of elastomer material having a width to bridge marginal edges of adjacent deck sections; load supporting splines in said strip spaced apart to support load travelling between adjacent deck sections in use; said splines extending at an incline to the longitudinal axis of said strip and between the marginal edge portions of the strip; said splines being responsive to expansion or contraction of the width of the strip to rotate and vary their angle of inclination to the longitudinal axis of the strip and prevent buckling of the surface of the strip. The invention will be clearly understood after reference to the following detailed specification read in conjunction with the drawings.

Figure 1:
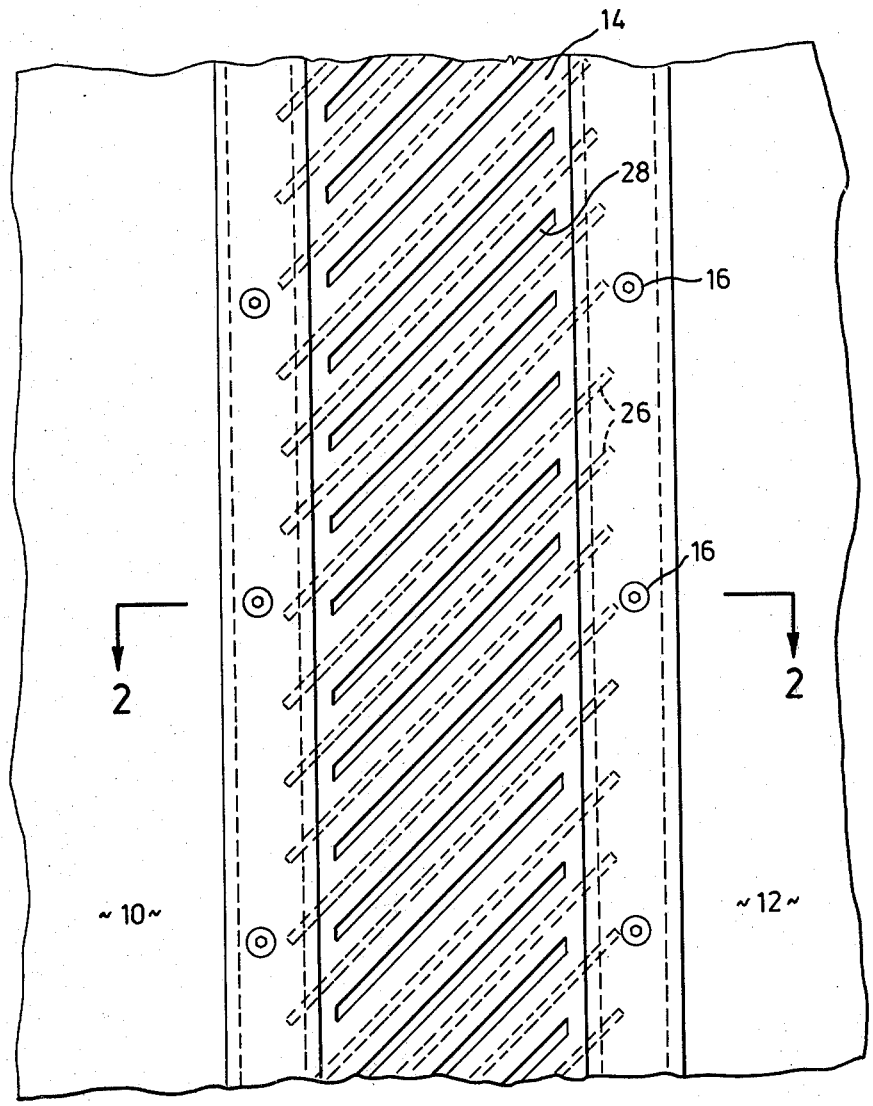
FIG. 1 is a plan view of a portion of an expansion joint seal mounted in place across the gap between adjacent deck sections of a bridge.
Figure 2:
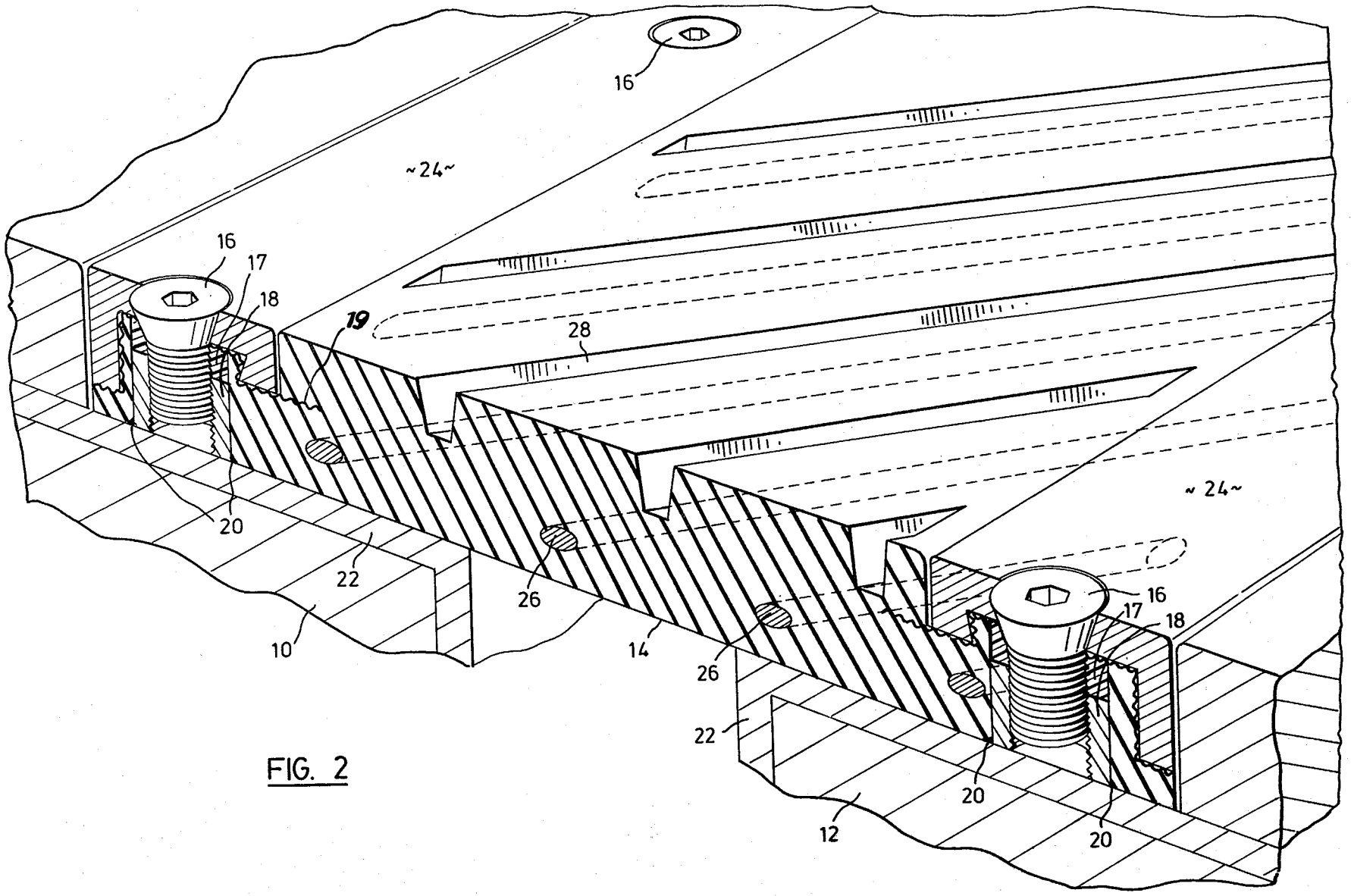
FIG. 2 is a sectional view along the line 2—2 of FIG. 1.

In the drawings, the numerals 10 and 12 indicate the marginal portions of two adjacent deck sections of a bridge. These sections are maintained in this relationship upon the substructure of a bridge according to standard bridge practice. Provision is made for the expansion and contraction of the sections with varying climatic conditions. The deck sections expand under warm weather conditions with the result that the gap between them becomes smaller. Under cold weather conditions they contract with the result that the gap between them tends to become larger. In practice, this gap can be upwards of 8 inches depending on the length of bridge spans involved. Water and dirt tend to fall through the gap onto the underlying bridge structure. This water and dirt can cause serious damage to the bridge structure and the impact of traffic passing over an open gap can cause serious damage to the bridge structure. It, thus, becomes necessary to provide a seal for the gap that will seal the gap and prevent the water and dirt from reaching the substructure, bridge the gap and support load passing over the deck sections and at the same time allow for movement of the deck sections relative to each other.

The expansion joint seal according to this invention fulfills these requirements well and efficiently.

The seal comprises a strip of elastomer material 14 secured along each of its longitudinal marginal edges to the deck sections 10 and 12 by means of bolts 16. The bolts 16 thread into the tubular sockets 18 that are welded as at 20 to a metal plate 22 that is secured to the edge of each of the deck sections 10 and 12. The bolts 16 extend through a clamping channel 24 that sits over a complementary tongue on the marginal edge portions of the elastomer strip. Numeral 19 is a piece of fabric to prevent necking of the elastomer at the edges of the seal under conditions of stress. Numeral 17 is an elastomer sealant.

Load supporting splines 26 are embedded in the elastomer strip 14 and extend at an incline to the longitudinal axis of the strip. The splines extend to the marginal edge portions of the strip where they overlie the adjacent deck sections 10 and 12 so that in use they are able to support load travelling over the bridge sections and across the gap between them. They give the strip ability to support this load and prevent buckling of the strip. In practice, a spring steel of a diameter of about $\frac{1}{4}$ of an inch 2 inches apart has proved successful for a 2 inch gap. However, the shape and diameter and spacing of the sections 26 is not critical, it only being necessary that they be of sufficient strength to support the load passing over the bridge as their free ends overlie the marginal edge portions of the deck sections.

The surface of the strip is formed with a series of grooves 28 which are designed to compensate for displacement of the elastomer material as the deck sections move towards each other and tend to compress the seal.

Consider for example, that the seal is mounted in unstressed condition at a mid-ambient temperature so that the gap between the sections is neither at its maximum nor its minimum proportions. Suppose that the temperature should increase. The deck sections would expand and the gap between them would become smaller. This will cause the elastomer material of the strip 14 to become compressed. As it does so the inclined reinforcing splines 26 will tend to incline to a lesser extent with respect to the longitudinal axis of the strip as they rotate in the general plane of the strip. As they rotate their free ends remain in overlying relation with respect to the edges of the deck sections 10 and 12 and they continue to provide support for loads or traffic travelling over the deck sections.

As indicated the grooves 28 allow for displacement of the elastomer material under these conditions of compression.

Under conditions of cooling the deck sections contract and the gap between them increases. Under these conditions the elastomer material is stretched and the load supporting splines 26 incline in the opposite direction and increase the angle of inclination as they rotate in the general plane of the strip.

The angle of the load supporting splines 26 with respect to the longitudinal axis of the strip is preferably about 45° at manufacture. It will be apparent that this angle could be modified if, for example, one were to decrease the angle from 45°, it would be easier to compress the strip. Increasing the angle from 45° would make it more difficult to compress the strip. There are some bridge applications where the bridge sections and the gap between them extends at an acute angle with the longitudinal axis of the roadway across the bridge (skew bridges). In these cases an incline of the load supporting splines 26 greater than 45° would have the same effect as an incline of 45° with a normal bridge. Determination of the angle is a matter of design and will vary from application to application, the important thing being that the load supporting splines, because of their inclination, are responsive to expansion or contraction of the width of the strip to vary their angle of inclination to the longitudinal axis of the strip and be spaced apart to prevent buckling of the surface of the strip in use.

The strip is manufactured from a polyurethane type of plastic. To manufacture the strip one locates the load supporting splines 26 in appropriate position within a mold and pours heated liquid polyethelene into the mold to form the strip. No pressure is required in the molding of this material. The strip can be rolled after it has been manufactured for transport to a job location and can be provided in a length to extend entirely across the width of a roadway so that the seal can be provided in one piece across a roadway. When mounted in position and sealed at the marginal edges to the deck sections with a sealing compound, the seal along the edge of the strip is water-tight at the channel sections.

The strip can be manufactured from any suitable material. Natural rubber is an alternative suitable material. When molding with this material it would be applied into the mold in layers and then subjected to pressure and heat to mold the product (pressure molding).

The spring steel splines that support the load in use are molded into the strip, but it is not inconceivable that they could be inserted into a strip after it was molded by boring the strip with appropriate holes, inserting the splines and then plugging the hole.

It is also contemplated to reinforce the strip with nylon or polyester cords in a direction longitudinally of the strip. This reinforcement serves to reinforce the strip against wear due to traffic passing over the strip. Cords can be so located in the molding process by inserting a fabric in the strip in overlying and/or underlying relation to the supporting splines. The fabric should have the warp threads extending longitudinally of the strip and the weft threads extending transversely of the strip and the warp threads should be strong to give the necessary reinforcement against traffic wear. The weft threads on the other hand should be weak and adapted to break as the seal expands and contracts during use. The weft threads are merely serving the purpose of supporting the warp as the fabric is embedded into the strip.

There are other ways of incorporating a reinforcing cord into the strip. One could, for example, have a fabric in which the threads extend diagonally, one of the diagonal lines being aligned with the inclined load supporting splines. Threads so inclined would give the necessary reinforcement to traffic wear and also would not be stressed as the bridge sections expand and contract because they would rotate with a similar motion to the steel reinforcing splines 26.

Embodiments of the invention other than the one illustrated will be apparent to those skilled in the art and it is not intended that the invention should be restricted to the embodiment illustrated in the drawings.

It is contemplated for example that more than one layer of load supporting splines be incorporated and that one layer be inclined at say 90° to the other. This and other matters of design are modifications within the skill in the art.

The embodiments of the invention in which an exclusive property or privilege is claimed are defined as follows:

1. In an expansion joint seal for a gap in a bridge or like decking a strip of elastomer material having a width to bridge marginal edges of adjacent deck sections;

load supporting splines in said strip, bonded to the elastomer material thereof and spaced apart to support load travelling between adjacent deck sections in use;

said splines extending at an incline to the longitudinal axis of said strip and between the marginal edge portions of the strip;

said splines being responsive to expansion or contraction of the width of the strip to rotate and vary their angle of inclination to the longitudinal axis of the strip and prevent buckling of the surface of the strip.

2. In an expansion joint seal for a gap in a bridge or the like as claimed in claim 1 wherein the angle of inclination of the splines is about 45° to the longitudinal axis of the strip when the strip is relaxed.

3. In an expansion joint seal for a gap in a bridge or the like as claimed in claim 1 or claim 2 in which the splines are steel.

* * * * *